US009994990B2

(12) United States Patent
Lee et al.

(10) Patent No.: US 9,994,990 B2
(45) Date of Patent: Jun. 12, 2018

(54) DRUM WASHING MACHINE

(71) Applicant: SAMSUNG ELECTRONICS CO., LTD., Suwon-si, Gyeonggi-do (KR)

(72) Inventors: In Ju Lee, Yongin-si (KR); Min Jea Choi, Suwon-si (KR); Doo Young Ryu, Suwon-si (KR); Ji Sung Kim, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 1283 days.

(21) Appl. No.: 14/025,247

(22) Filed: Sep. 12, 2013

(65) Prior Publication Data

US 2014/0076006 A1 Mar. 20, 2014

(30) Foreign Application Priority Data

Sep. 14, 2012 (KR) ..... 10-2012-0102431
Aug. 22, 2013 (KR) ..... 10-2013-0099514

(51) Int. Cl.
*D06F 37/30* (2006.01)
*D06F 37/22* (2006.01)

(52) U.S. Cl.
CPC ..... *D06F 37/30* (2013.01); *D06F 37/22* (2013.01)

(58) Field of Classification Search
CPC ..... D06F 37/206; D06F 37/304; D06F 37/22; D06F 37/269; D06F 37/30
USPC ..... 68/140, 24, 58, 3 R, 23.1, 139, 12.24, 68/23 R, 23.7, 13 R, 142, 19.2; 310/43, 310/67 R, 156.26, 51, 90, 91, 113, 114, 310/156.12
See application file for complete search history.

(56) References Cited

U.S. PATENT DOCUMENTS 5,873,269 A 2/1999 Hong et al.
2007/0125135 A1* 6/2007 Kim ..... D06F 37/304 68/140
2009/0223257 A1* 9/2009 Kim ..... D06F 37/20 68/23.1

FOREIGN PATENT DOCUMENTS

| | | |
|---|---|---|
| CN | 1191252 | 8/1998 |
| CN | 2657264 | 11/2004 |
| CN | 101037838 | 9/2007 |
| CN | 102506088 | 6/2012 |
| CN | 102628208 | 8/2012 |

(Continued)

OTHER PUBLICATIONS

European Search Report dated Feb. 2, 2014 in corresponding European Application No. 13183992.0.

(Continued)

*Primary Examiner* — David G Cormier
*Assistant Examiner* — Thomas Bucci
(74) *Attorney, Agent, or Firm* — Staas & Halsey LLP

(57) ABSTRACT

A drum washing machine includes a cabinet, a tub located within the cabinet, a drum rotatably located within the tub, and a drive unit to rotate the drum, and the drive unit includes a motor, a shaft provided with one end defined as a first point and combined with the drum and the other end defined as a second point and combined with a rotor of the motor and transmitting power of the motor to the drum, first and second bearings located between the first and second points, a first groove provided between the first bearing and the first point to prevent damage to the shaft, and a bushing surrounding at least a portion of the outer surface of the shaft and the contour of the first groove.

24 Claims, 15 Drawing Sheets

(56) References Cited

FOREIGN PATENT DOCUMENTS

| | | | |
|---|---|---|---|
| EP | 1 514 965 | | 3/2005 |
| EP | 1 724 437 | | 11/2006 |
| EP | 1 724 437 | A1 | 11/2006 |
| EP | 2 325 370 | A2 | 5/2011 |
| GB | 2 324 309 | | 10/1998 |
| KR | 10-2005-0110970 | | 11/2005 |

OTHER PUBLICATIONS

Chinese Office Action dated Sep. 1, 2016 from Chinese Patent Application No. 201310421509.9, 16 pages.
Decision on Grant issued May 4, 2017 in corresponding Chinese Patent Application No. 20130421509.9.
European Examination Report dated Mar. 22, 2018 from European Patent Application No. 13183992.0, 5 pages.

* cited by examiner

DRUM WASHING MACHINE

CROSS-REFERENCE TO RELATED APPLICATIONS

This application claims the benefit of Korean Patent Applications Nos. 10-2012-0102431, filed on Sep. 14, 2012, and 10-2013-99514, filed on Aug. 22, 2013, in the Korean Intellectual Property Office, the disclosures of which are incorporated herein by reference.

BACKGROUND

1. Field

Embodiments of the present disclosure relate to a drum washing machine which has an improved structure of a shaft to prevent damage to the shaft or abrasion of the shaft.

2. Description of the Related Art

A drum washing machine washes clothes using electric power, and generally includes a tub storing wash water, a drum rotatably installed within the tub, and a motor rotating the drum.

Such a drum washing machine washes laundry using falling of water while rotating the drum, uses an electric motor as a main power source, and performs a washing, rinsing and spin-drying process so as to remove contaminants from the laundry using detergent and water.

The drum washing machine may rotate the drum at a high speed during the washing, rinsing and spin-drying process. The drum is rotated by the motor, and driving power of the motor is transmitted to the drum by a shaft.

Conventionally, when stress is concentrated on a designated portion of the shaft, one side of the shaft is cracked. Due to cracking, portions of the shaft at which stress is not concentrated are damaged and thus, the shaft is finally is broken.

Further, conventionally, friction between the shaft and a bearing and abrasion of the shaft and the bearing are generated due to a difference between the rotational speed of the shaft and the rotational speed of the bearing during operation of the washing machine. This generates a gap between the shaft and the bearing and thus causes vibration and noise and damage to the bearing. In order to solve such a problem, an O-ring is used. However, in this case, it may be difficult to ensure durability.

SUMMARY

Therefore, it is an aspect of the present disclosure to provide a drum washing machine having a structure which increases strength of a shaft to prevent damage to the shaft.

Additional aspects of the disclosure will be set forth in part in the description which follows and, in part, will be apparent from the description, or may be learned by practice of the disclosure.

In accordance with one aspect of the present disclosure, a drum washing machine includes a cabinet forming the external appearance of the drum washing machine, a tub located within the cabinet, a drum rotatably located within the tub, and a drive unit to rotate the drum, wherein the drive unit includes a motor, a shaft provided with one end defined as a first point and combined with a rotor of the motor and the other end defined as a second point and combined with the drum and transmitting power of the motor to the drum, a first bearing and a second bearing located between the first point and the second point, a first groove provided at one side of the shaft between the first bearing and the second point to prevent damage to the shaft, and a bushing surrounding at least a portion of the outer surface of the shaft to surround the contour of the first groove.

At least one bearing mount surface with which the bearings may be combined is provided on the shaft.

The at least one bearing mount surface may include a first bearing mount surface and a second bearing mount surface, and the first groove is separated from the first and second bearing mount surfaces.

A bushing mount surface with which the bushing is combined may be provided on the shaft.

A second groove may be provided at the boundary between the bushing mount surface and the at least one bearing mount surface.

The drum washing machine may further include at least one elastic member located between the bushing and the first bearing.

The drum washing machine may further include a sealing member surrounding at least one portion of the bushing to prevent moisture from permeating the bearings.

The drum washing machine may further include at least one elastic member located between the bushing and the first bearing, and the at least one elastic member may be located in the second groove.

Inclined parts may be provided at both sides of the first groove.

The inclined parts of the first groove may be rounded.

The first groove may be formed in a ring shape.

The first groove may be formed in a continuous ring shape.

The first groove may include a plurality of depressions discontinuously provided.

A distance between the drum and the bushing mount surface may be shorter than a distance between the drum and the at least one bearing mount surface.

In accordance with another aspect of the present disclosure, a drum washing machine which has a tub and a drum located within the tub, includes a motor generating power to rotate the drum, and a shaft transmitting power of the motor to the drum, wherein the shaft includes a drum combined part with which the drum is combined, a motor combined part with which the motor is combined, at least one mount surface having a stepped structure with the surface of the shaft, and a first groove provided at at least a portion of the at least one mount surface.

The at least one mount surface may include a bushing mount surface with which a bushing to prevent the surface of the shaft from rusting is combined, and a bearing mount surface with which a bearing to facilitate rotation of the shaft is combined.

The drum washing machine may further include at least one elastic member located between the bushing and the first bearing, and the at least one elastic member may be located in a second groove provided on the bushing mount surface.

The second groove may have a stepped portion with the bearing mount surface.

The second groove may be rounded with respect to the bearing mount surface.

In accordance with yet another aspect of the present disclosure, a drum washing machine includes a cabinet forming the external appearance of the drum washing machine, a tub located within the cabinet, a drum rotatably located within the tub, and a drive unit to rotate the drum, wherein the drive unit includes a motor, a shaft provided with one end defined as a first point and combined with a rotor of the motor and the other end defined as a second point and combined with the drum, and transmitting power of the motor to the drum, a first bearing and a second bearing located between the first point and the second point, and at least one groove provided in front of the first bearing of the shaft.

The at least one groove may include a first groove and a second groove provided so as to be closer to the first bearing than the first groove.

The drum washing machine may further include a bushing surrounding at least a portion of the outer surface of the shaft, and at least one elastic member in a ring shape located between the first bearing and the busing and inserted into the shaft, and the second groove and the at least one elastic member may contact each other.

The second groove may have a stepped portion with the surface of the shaft.

The at least one elastic member may include a first elastic member contacting the first bearing and a second elastic member contacting the bushing, and the inner diameter of the first elastic member and the inner diameter of the second elastic member may be equal.

The second groove may be rounded with respect to the surface of the shaft.

The at least one elastic member may include a first elastic member contacting the first bearing and a second elastic member contacting the bushing, and the inner diameter of the second elastic member may be smaller than the inner diameter of the first elastic member.

The drum washing machine may further include a sealing member surrounding at least one portion of the bushing to prevent moisture from permeating the bearing, and the outer diameter of the at least one elastic member may be smaller than the inner diameter of the sealing member.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
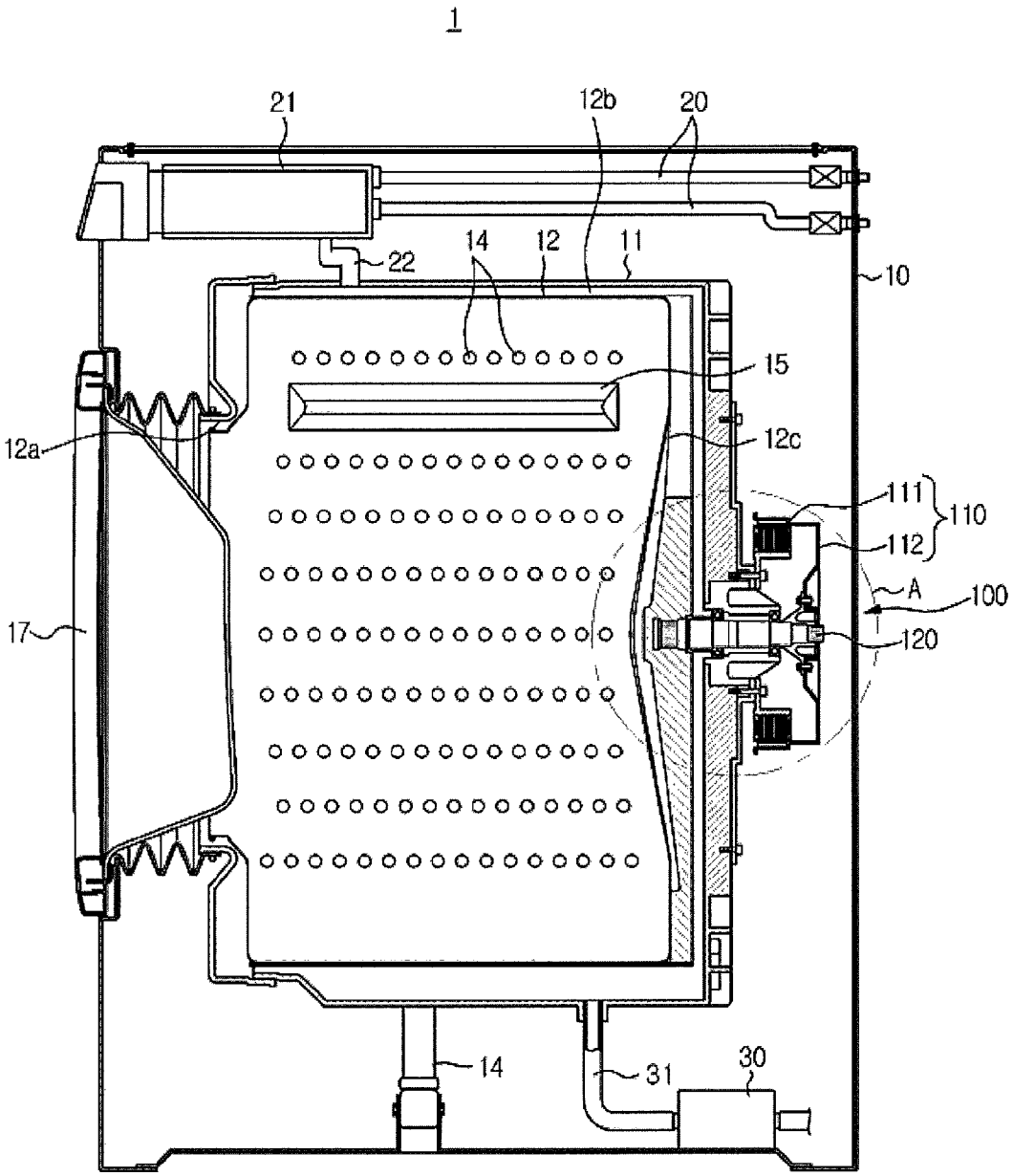
FIG. 1 is a cross-sectional view of a drum washing machine in accordance with one embodiment of the present disclosure.

Reference will now be made in detail to the embodiments of the present disclosure, examples of which are illustrated in the accompanying drawings, wherein like reference numerals refer to like elements throughout.

FIG. 1 is a cross-sectional view of a drum washing machine in accordance with one embodiment of the present disclosure.

As shown in FIG. 1, a drum washing machine 1 includes a cabinet 10 forming the external appearance of the drum washing machine 1, a tub 11 disposed within the cabinet 10, a drum 12 rotatably disposed within the tub 11, and a drive unit 100 to rotate the drum 12. According to embodiments, the tub 11 may be formed integrally with the cabinet 10, or the tub 11 may be omitted.

An inlet through which laundry may be put into the drum 12 is formed on the front surface of the cabinet 10. The inlet is opened and closed by a door 17 installed on the front surface of the cabinet 10.

A control panel (not shown) may be installed at the upper region of the front portion of the cabinet 10. The control panel (not shown) may be configured so as to control a washing, rinsing or spin-drying cycle. Further, the control panel (not shown) may display information regarding washing, such as a washing time or a washing course, so that a user may recognize the information regarding washing.

The tub 11 may be elastically supported by the cabinet 10. The tub 11 may be supported by the cabinet 10 using an elastic member (not shown) and a damping member 14. The elastic member (not shown) and the damping member 14 may reduce transmission of vibration of the tub 11 and impact applied to the tub 11 to the cabinet 10. The elastic member (not shown) may include a spring, and the damping member 14 may include an oil damper.

Water supply pipes 20 to supply wash water to the tub 11 are installed above the tub 11. One end of each of the water supply pipes 20 is connected to an external water supply source (not shown), and the other end of each of the water supply pipes 20 is connected to a detergent supply device 21.

The detergent supply device 21 is connected to the tub 11 through a connection pipe 22. Water supplied through the water supply pipes 20 passes through the detergent supply device 21, and then is supplied to the inside of the tub 11 together with detergent.

A drain pump 30 and a drain pipe 31 to discharge water in the tub 11 to the outside of the cabinet 10 are installed under the tub 11.

The drum 12 may be rotatably supported by the tub 11. The drum 12 may be supported by the tub 11, be rotated alternately in the clockwise direction and the counterclockwise direction, and be rotated at a high speed.

The drum 12 includes a cylindrical member 12*b*, a front plate 12*a* disposed at the front portion of the cylindrical member 12*b*, and a rear plate 12*c* disposed at the rear portion of the cylindrical member 12*b*. An opening through which laundry is put into and taken out of the drum 12 is formed on the front plate 12*a*.

Plural through holes 14 to circulate wash water are formed on the circumference of the drum 12, and plural lifters 15 to lift and drop laundry when the drum 12 is rotated are installed on the inner circumferential surface of the drum 12.

The drive unit 100 includes a motor 110 to generate power to rotate the drum 12, and a shaft 120 transmitting driving power generated from the motor 110 to the drum 12. The drive unit 100 is combined with the rear plate 12*c* of the drum 12, and will be described later.

Figure 2:
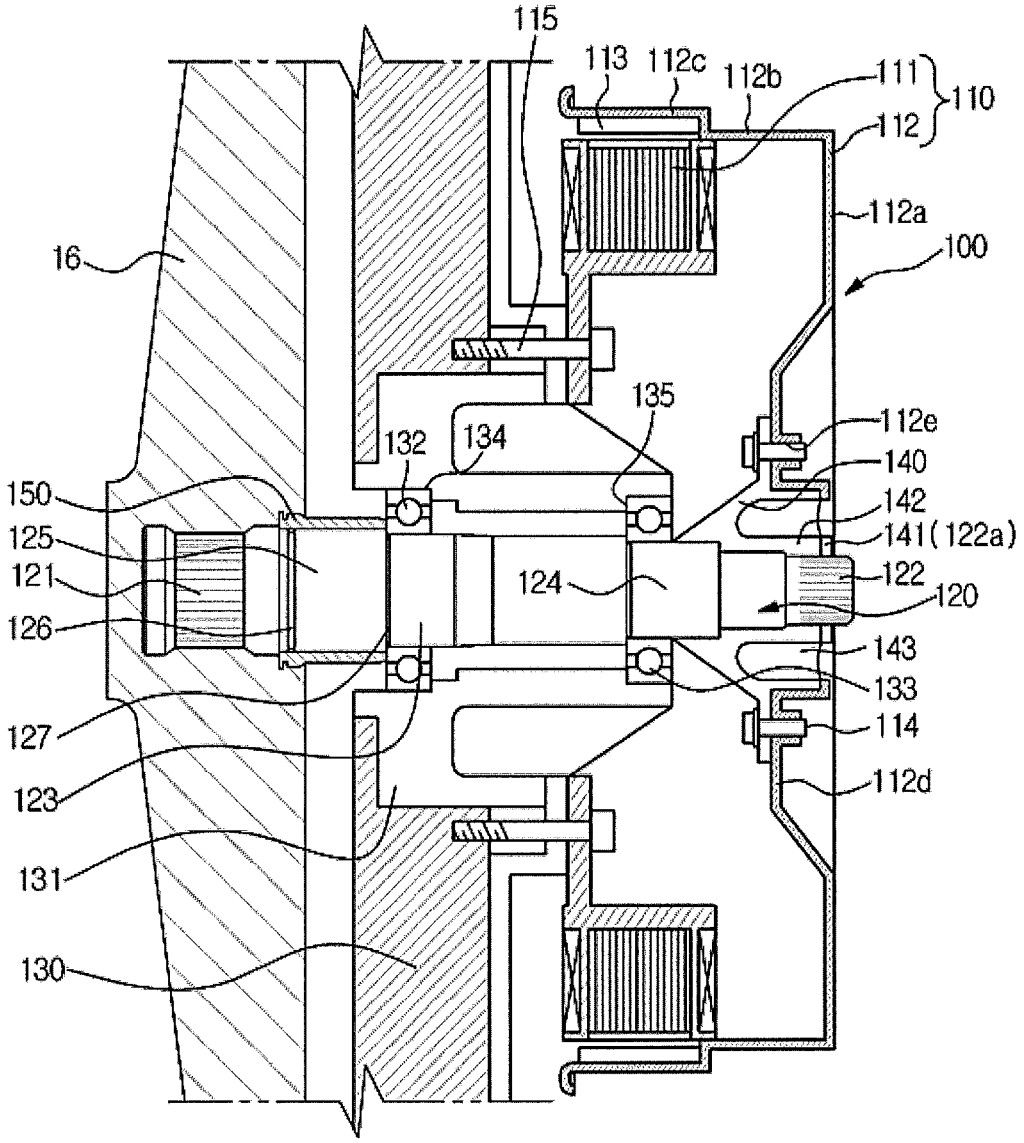
FIG. 2 is an enlarged view of the portion A of FIG. 1.

FIG. 2 is an enlarged view of the portion A of FIG. 1.

The drive unit 100 is connected to the rear plate 12*c* of the drum 12 (with reference to FIG. 1). Particularly, one end of the shaft 120 of the drive unit 100 may be connected to the rear plate 12*c*, and the other end of the shaft 120 may be extended to the outside of the rear wall of the tub 11 and combined with a rotor 112 of the motor 110. Therefore, when the motor 110 drives the shaft 120, the drum 12 connected to the shaft 120 is rotated about the shaft 120. A portion of the shaft 120 with which the drum 12 is combined is defined as a drum combined part 121, and a portion of the shaft 120 with which the motor 110 is combined is defined as a motor combined part 122. Further, one end of the shaft 120 combined with the drum 12 is defined as a first point, and the other end of the shaft 120 combined with the rotor 112 is defined as a second point.

The motor 110 may include the rotor 112 and a stator 111. The rear end of the shaft 120 is connected to the rotor 112. The stator 111 is located within the rotor 112, and is coupled with the rear wall of the tub 11, for example by fasteners 115, so that the stator 111 and the rotor 112 constitute the motor 110. The rotor 112 is rotated by interaction between the rotor 112 and the stator 111, and thus the shaft 120 may be rotated.

A bearing housing 130 may be installed on the rear wall of the tub 11 so as to rotatably support the shaft 120. The bearing housing 130 may be formed of an aluminum alloy, and may be inserted into the rear wall of the tub 11 when the tub 11 is formed by injection molding. At least one bearing 132 and 133 to facilitate rotation of the shaft 120 may be installed between the bearing housing 130 and the shaft 120. As shown in FIG. 2, the at least one bearing 132 and 133 may include a first bearing 132 and a second bearing 133. The first bearing 132 and the second bearing 133 may be located between the first point and the second point of the shaft 120. That is, the first bearing 132 and the second bearing 133 may be located between the drum combined part 121 and the motor combined part 122.

A bearing housing hub 131 in which the bearings 132 and 133 are located may be formed integrally with the center of the bearing housing 130. Hanging parts 134 and 135 supporting the first bearing 132 and the second bearing 133 to prevent the respective bearings 132 and 133 from being separated from the bearing housing 130 may be formed on the inner circumferential surface of the bearing housing hub 131 at the center of the bearing housing 130. From among the hanging parts 134 and 135 formed on the inner circumferential surface of the bearing housing 130, the first hanging part 134 located at the front is formed in a "¬" shape so as to form a structure supporting the rear end of the first bearing 134. From among the hanging parts 134 and 135 formed on the inner circumferential surface of the bearing housing 130, the second hanging part 135 located at the rear is formed in the direction opposite the first hanging part 134 so as to form a structure supporting the front end of the second bearing 135.

Bearing mount surfaces 123 and 124 to determine the mounting positions of the first bearing 132 and the second bearing 133 on the shaft 120 may be provided on the outer circumferential surface of the shaft 120. The surface on which the first bearing 132 is located is defined as a first bearing mount surface 123, and the surface on which the second bearing 133 is located is defined as a second bearing mount surface 124.

Further, a connector 140 transmitting rotating force of the rotor 112 to the shaft 120 may be provided at the rear portion of the shaft 120. The connector 140 may be combined with the outer circumferential surface of the rear portion of the second bearing 133 of the shaft 120 by serrations, and may be coupled with the rotor 112.

The front end of the shaft 120 is combined with a spider 16 provided on the rear wall portion of the drum 12. A bushing 150 to prevent the surface of the shaft 120 from rusting may be provided in a region from the portion of the shaft 120 exposed from the rear portion of the spider 16 to the first bearing 132. The bushing 150 may be installed by press fitting. The bushing 150 may surround at least a portion of the outer surface of the shaft 120. The bushing 150 may be formed of brass. Further, a sealing member (not shown) to prevent moisture from permeating the bearings 132 and 133 may be installed on the outer surface of the bushing 150.

The rotor 112 of the motor 110 may be coupled with the center of the rear end of the shaft 120. The stator 111 coupled with and fixed to the bearing housing 130 to constitute the motor 110 together with the rotor 112 may be located within the rotor 112.

The rotor 112 is formed of a steel plate, and magnets 113 are located on the inner surface of a side wall 112*b* extended forwardly from the edge of the rear wall 112*a* of the rotor 112. A bending part 112*c* having a mount surface may be provided on the side wall 112*b* so as to support the magnets 113. Coupling members 114 to prevent the connector 140 combined with the rotor 112 from being separated from the shaft 120 may be combined with the rear wall 112*a*. A rotor hub part 112*d* provided with through holes 112*e* to be combined with the coupling members 114 may be provided on the rear wall 112*a*.

A connector serration 141 corresponding to a shaft serration 122*a* formed on the rear end of the shaft 120 may be formed on the inner circumferential surface of a connector hub 142 provided at the center of the connector 140. Further, reinforcing ribs 143 to reinforce the strength of the connector hub 142 may be provided on the outer surface of the connector hub 142.

Figure 3:
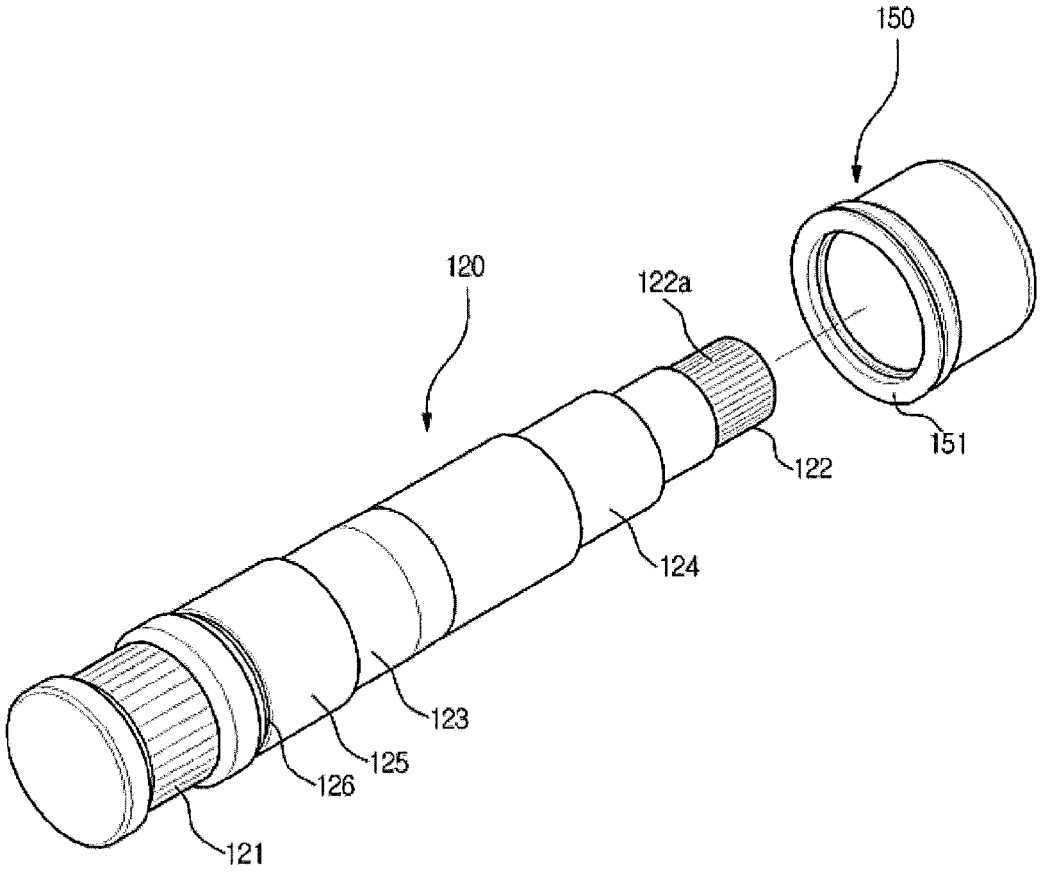
FIG. 3 is an exploded view illustrating a shaft and a bushing in accordance with the embodiment of the present disclosure.
Figure 4:
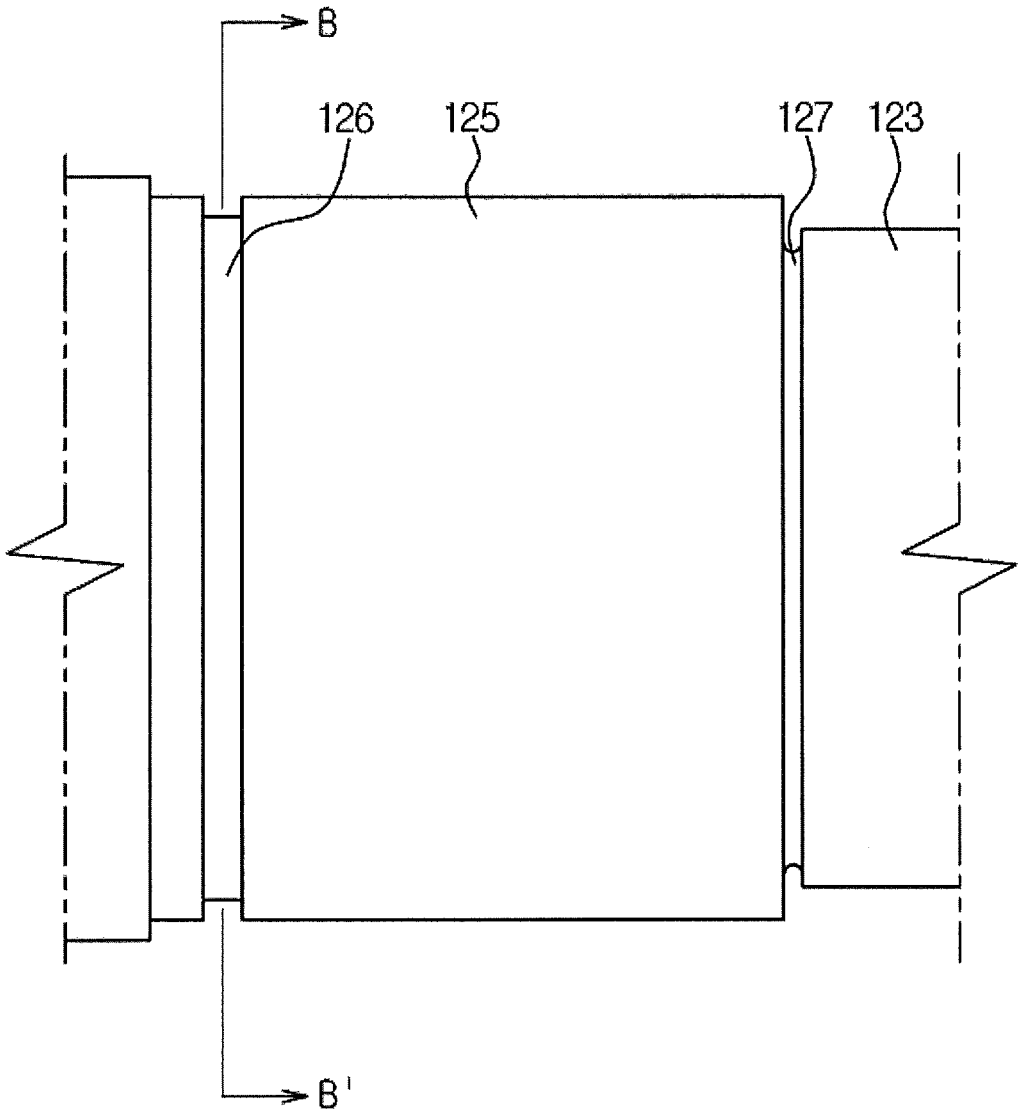
FIG. 4 is an enlarged view of the shaft in accordance with the embodiment of the present disclosure.
Figure 5:
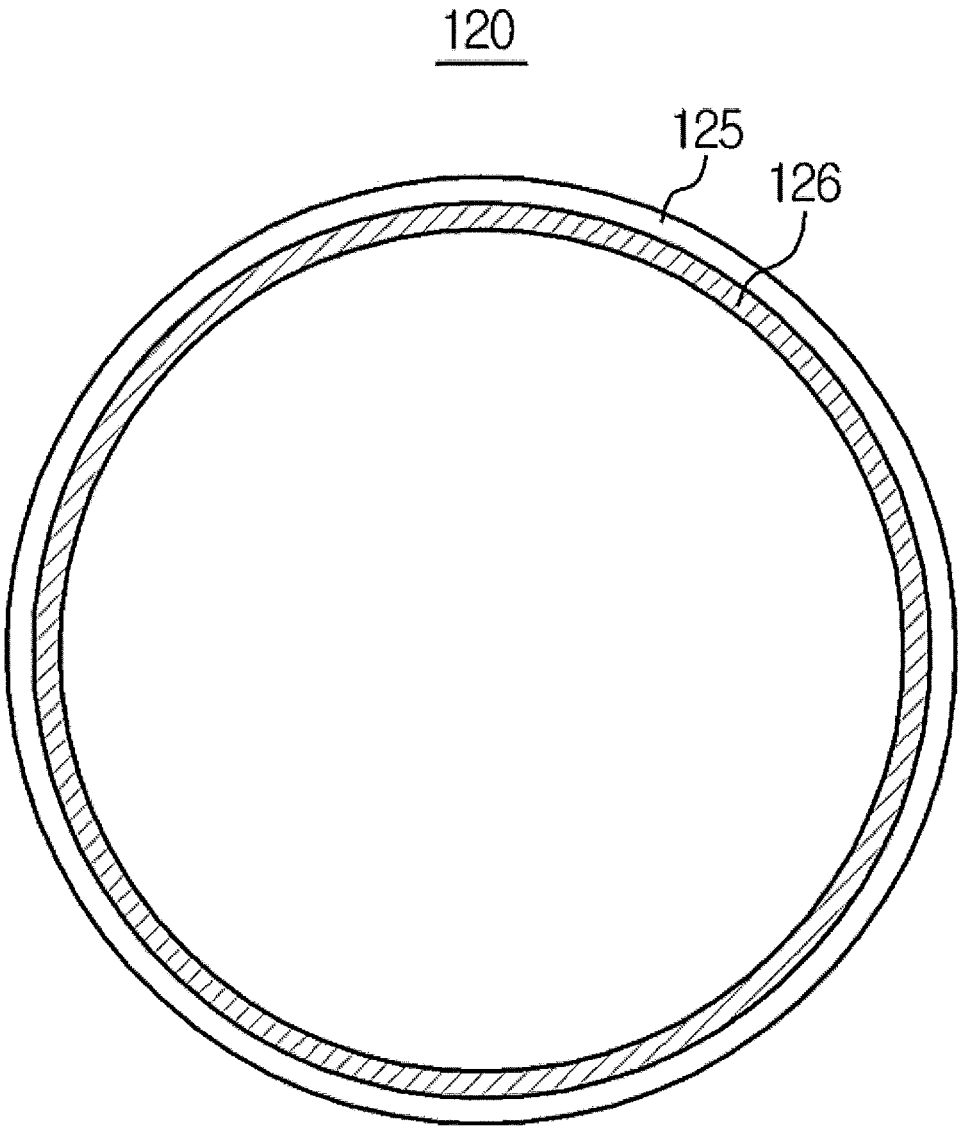
FIG. 5 is a cross-sectional view taken along the line B-B' of FIG. 4.
Figure 6:
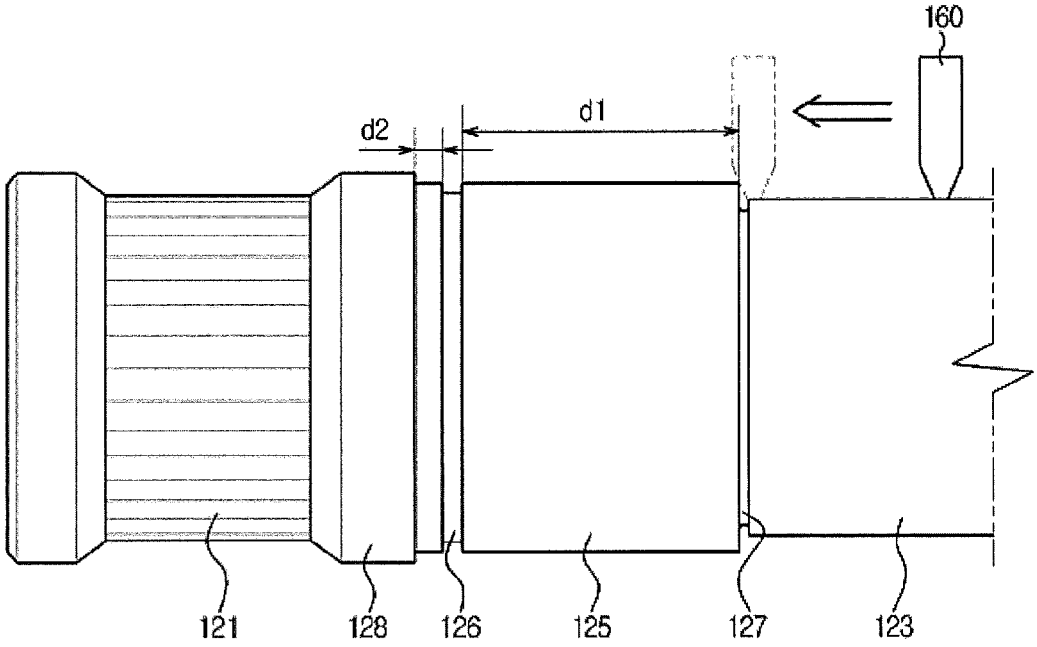
FIG. 6 is a view illustrating polishing of one end of the shaft in accordance with the embodiment of the present disclosure.

FIG. 3 is an exploded view illustrating the shaft and the bushing in accordance with the embodiment of the present disclosure, FIG. 4 is an enlarged view of the shaft in accordance with the embodiment of the present disclosure, FIG. 5 is a cross-sectional view taken along the line B-B' of FIG. 4, and FIG. 6 is a view illustrating polishing of one end of the shaft in accordance with the embodiment of the present disclosure.

As shown in FIGS. 3 to 6, the drum combined part 121 with which the rear wall of the drum 12, i.e., the spider 16, is combined is provided at one end of the shaft 120. A projection 128 to increase combining force between the shaft 120 and the drum 12 may be provided at one side of the drum combined part 121. Further, the motor combined part 122 with which the motor 110 is combined is provided at the other end of the shaft 120 opposite the drum combined part 121. The motor combined part 122 may be combined with the rotor 112 through the connector 140. The drum combined part 121 and the motor combined part 122 may be respectively combined with the drum 12 and the motor 110 by serrations.

At least one mount surface 123, 124 and 125 with which various members are combined may be provided on the shaft 120. That is, a bushing mount surface 125 with which the bushing is combined and the bearing mount surfaces 123 and 124 with which the bearings 132 and 133 are combined may be provided. The bearing mount surfaces 123 and 124 have a stepped structure with the outer surface of the shaft 120 so as to combine the bearings 132 and 133 with the outer surface of the shaft 120.

The bushing 150 serves to prevent moisture from permeating from the drum 12 into the bearings 132 and 133, and may be located between the drum 12 and the bearings 132 and 133. Thereby, a distance between the drum 12 and the bushing mount surface 150 may be shorter than a distance between the drum 12 and the bearing mount surfaces 123 and 124. A separation prevention part 151 to prevent the bushing 150 from being separated from the shaft 120 may be provided at at least one side of the bushing 150.

Although the drawings illustrate the bearing mount surfaces 123 and 124 as including the first bearing mount surface 123 on which the first bearing 132 is mounted and the second bearing mount surface 124 on which the second bearing 133 is mounted, embodiments of the present disclosure are not limited thereto.

At least one groove 126 and 127 to prevent damage to the shaft 120 may be provided at one side of the shaft 120. The at least one groove 126 and 127 may be provided in front of the first bearing 132 of the shaft 120. In accordance with one embodiment of the present disclosure, the at least one groove 126 and 127 may include a first groove 126 and a second groove 127. The first groove 126 may be provided between the first bearing 132 and the second point. The first groove 126 may be separated from the first bearing mount surface 123. That is, the second groove 127 may be provided so as to be closer to the first bearing 132 than the first groove 126. In order to rotate the drum 12 according to operation of the drum washing machine 1, force is applied to the shaft 120 during a process of transmitting power of the motor 110 to the drum 12, and thus the shaft 120 is damaged due to stress generated from the inside of the shaft 120. The first groove 126 prevents such damage to the shaft 120, and serves to disperse stress concentrated on a designated portion of the shaft 120. Particularly, in case of the drum washing machine 1, when laundry is concentrated on a designated portion of the drum 12, unbalance may occur, and thus stress may be further concentrated on the shaft 120. In accordance with the embodiment of the present disclosure, concentration of stress on the shaft 120 may be prevented, and thus such a problem generated in the conventional drum washing machine may be solved. Stress tends to be concentrated on an edge portion of the shaft 120 provided with the first bearing mount surface 123 and, thus, in order to effectively disperse stress, the first groove 126 may be disposed as far away from the first bearing mount surface 123 as possible. Thereby, the first groove 126 may be provided on the bushing mount surface 125. The bushing 150 may surround at least a portion of the outer surface of the shaft 120 so as to surround the contour of the first groove 126. The first groove 126 may be formed in a ring shape along the surface of the shaft 120, but the first groove 126 is not limited thereto. In accordance with one embodiment of the present disclosure, the first groove 126 may be formed in a continuous ring shape.

However, if the first groove 126 is excessively far away from the first bearing mount surface 123 and comes close to the drum combined part 121, the rigidity of the drum combined part 121 may be lowered. In accordance with one embodiment of the present disclosure, the first groove 126 may be provided so as to be separated from the first bearing mount surface 123 by 99/1000 or more the entire length of the shaft 120. That is, as shown in FIG. 6, a distance d1 between the first groove 126 and the first bearing mount surface 123 may be 99/1000 or more the entire length of the shaft 120. Even in this case, a designated distance d2 between the drum combined part 121 and the first groove 126 is required. For example, if the entire length of the shaft 120 is 202 mm, the distance d1 between the first groove 126 and the first bearing mount surface 123 may be about 21 mm. In this case, the distance d2 between the drum combined part 121 and the first groove 126 may be about 4 to 5 mm.

The depth of the first groove 126 may be ¼ or more the width of the first groove 126. In accordance with one embodiment of the present disclosure, if the width of the first groove 126 is 2 mm, the depth of the first groove 126 may be 1 mm, but the first groove 126 is not limited thereto.

The bushing mount surface 125 may be distorted due to rotation of the drum 12. In order to prevent damage to the shaft 120 due to distortion of the bushing mount surface 125, the diameter of the bushing mount surface 125 may be greater than the diameter of the first bearing mount surface 123. Thereby, a stepped portion may be provided between the bushing mount surface 125 and the first bearing mount surface 123.

Further, the second groove 127 may be provided at the boundary between the first bearing mount surface 123 and the bushing mount surface 125. That is, the second groove 127 may be provided at the stepped portion between the bushing mount surface 125 and the first bearing mount surface 123. The surface of the shaft 120 is ground such that the diameter of the first bearing mount surface 123 is smaller than the diameter of the bushing mount surface 125. In this case, it may be difficult for a grinder 160 to grind the first bearing mount surface 123 contacting the bushing mount surface 125, and thus, the second groove 127 is provided at the boundary between the bushing mount surface 125 and the first bearing mount surface 123. Thereby, the grinder 160 grinds the surface of the shaft 120 up to a position where the second groove 127 is located, thus forming the first bearing mount surface 123. For the same reason, a groove may be provided on the second bearing mount surface 124.

Conventionally, stress is concentrated on the stepped portion between the first bearing mount surface 123 and the bushing mount surface 125, and the shaft 120 is damaged thereby. However, in accordance with one embodiment of the present disclosure, the first groove 126 is provided in addition to the second groove 127, and stress conventionally concentrated on the boundary between the bushing mount surface 125 and the first bearing mount surface 123 may be dispersed to the first groove 126. Further, the first groove 126 may reduce a difference of cross-sectional areas between the bushing mount surface 125 and the first bearing mount surface 123. Therefore, since stress concentrated on the designated portion of the shaft 120 is reduced, the drum washing machine 1 may be used for about 7,200 cycles, increased by 1,000 cycles as compared to the conventional drum washing machine, and thus the lifespan of the drum washing machine 1 may be extended. Further, in accordance with the embodiment of the present disclosure, the strength of the shaft 120 may be improved, and thus, a large-capacity drum washing machine may be mass-produced using such a shaft 120.

Figure 7:
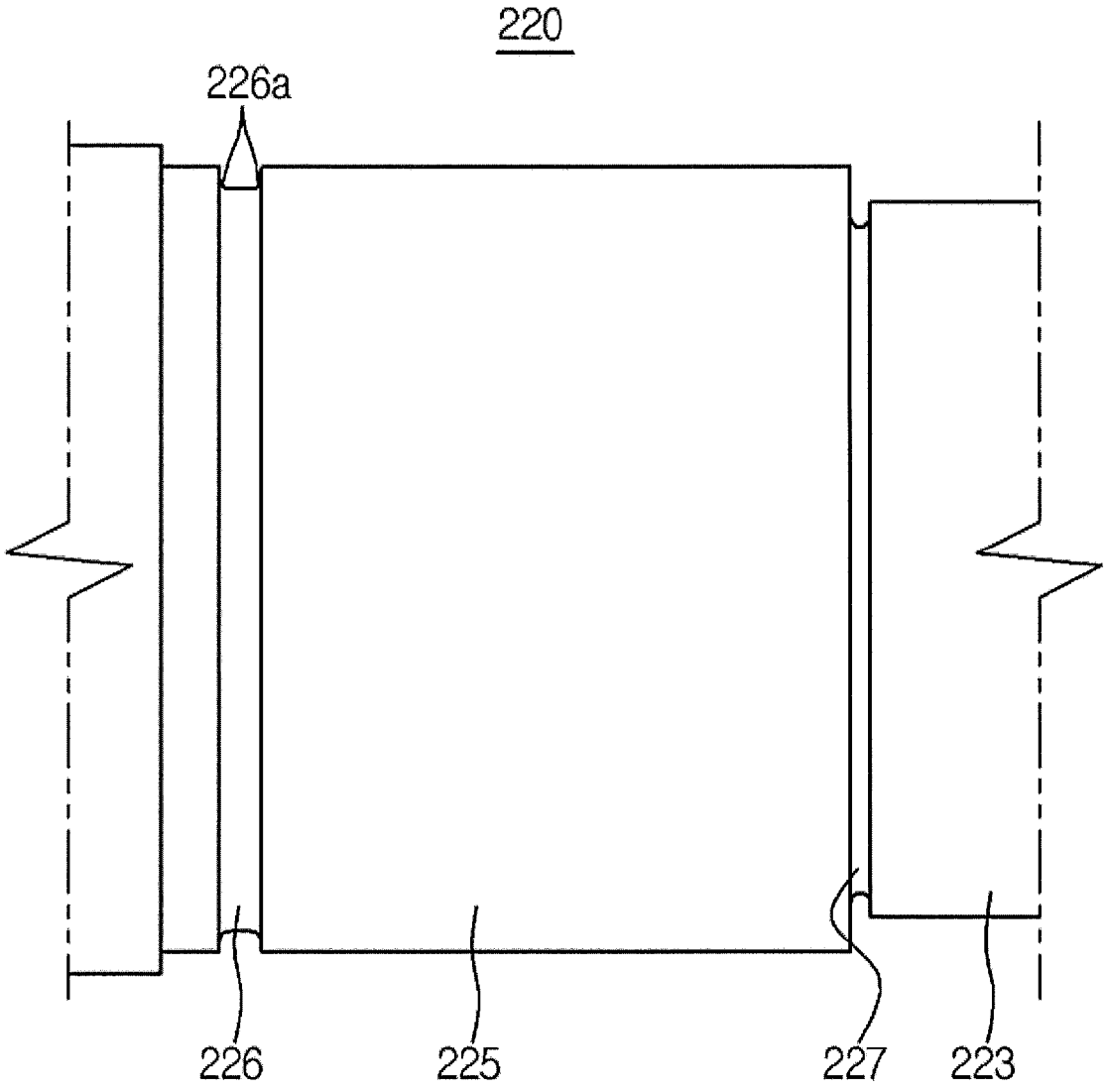
FIG. 7 is an enlarged view of a shaft in accordance with another embodiment of the present disclosure.

FIG. 7 is an enlarged view of a shaft 220 having a bearing mount surface 223, bushing mount surface 225, first groove 226 and second groove 227 in accordance with another embodiment of the present disclosure.

In accordance with the embodiment of the present disclosure shown in FIG. 7, inclined parts 226*a* may be provided at both sides of the first groove 226. The inclined parts 226*a* reduce a height difference between the surface of the first groove 226 and the surface of a shaft 220, and may more effectively prevent concentration of stress on a specific portion of the shaft 220 than in the embodiment of the present disclosure shown in FIGS. 1 to 6. In accordance with one embodiment of the present disclosure, the inclined parts 226*a* provided at both sides of the first groove 226 may be rounded. The radius r of the inclined parts 226*a* may be ¼ or more the entire width of the first groove 226. In accordance with one embodiment of the present disclosure, if the width of the first groove 226 is 2 mm, the radius r of the inclined parts 226*a* may be 0.5 mm.

Figure 8:
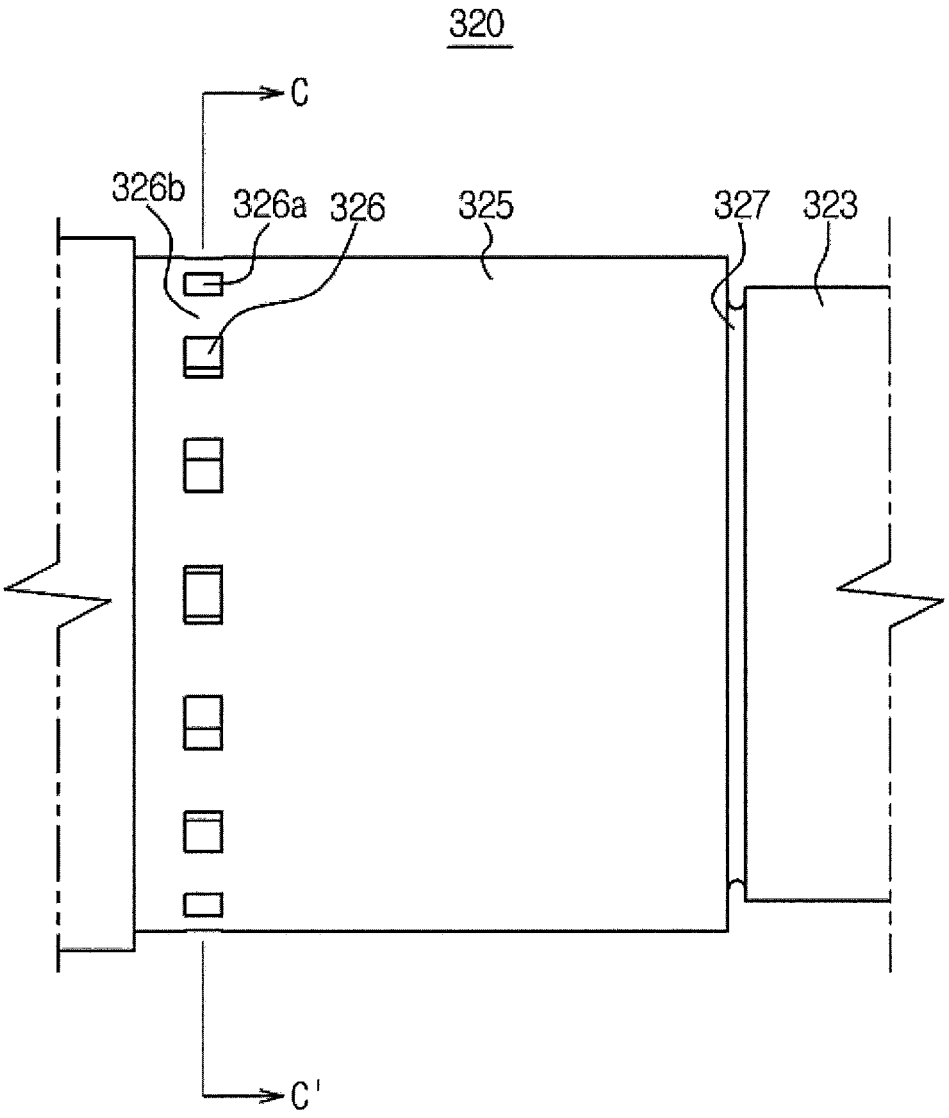
FIG. 8 is an enlarged view of a shaft in accordance with another embodiment of the present disclosure.
Figure 9:
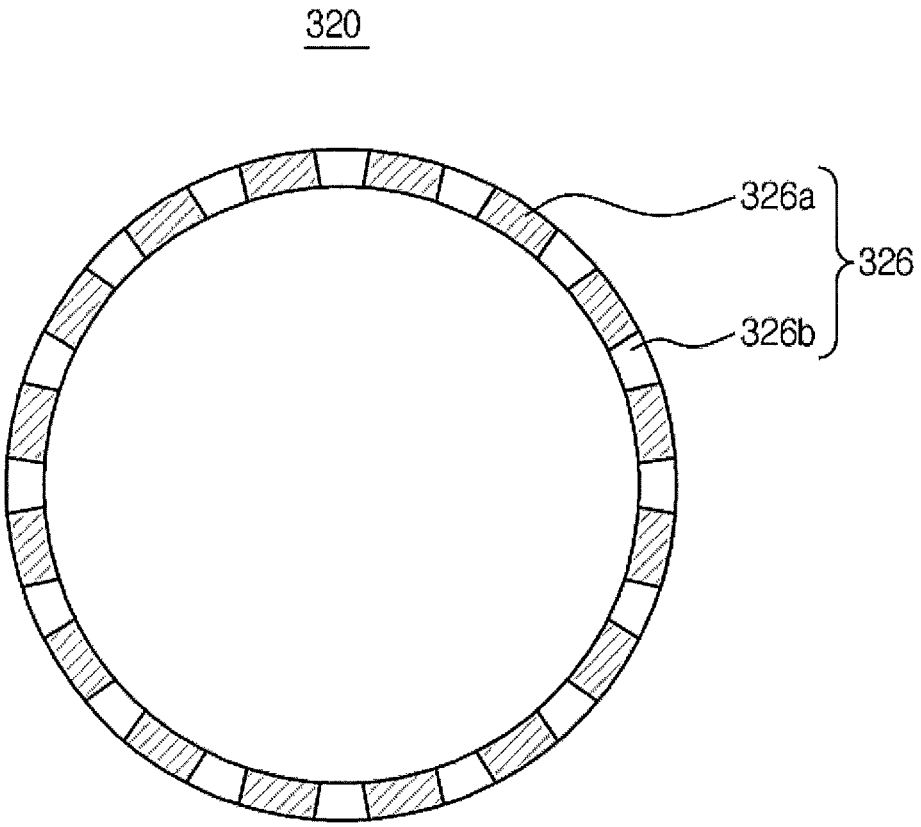
FIG. 9 is a cross-sectional view taken along the line C-C' of FIG. 8.

FIG. 8 is an enlarged view of a shaft 320 having a bearing mount surface 323, bushing mount surface 325, first groove 226 and second groove 327 in accordance with a further embodiment of the present disclosure and FIG. 9 is a cross-sectional view taken along the line C-C' of FIG. 8.

As shown in FIGS. 8 and 9, the first groove 326 may be discontinuously provided. That is, the first groove 326 includes depressions 326*a* provided on the surface 326*b* of a shaft 320. That is, the depressions 326*a* are provided at designated intervals on the surface 326*b* of the shaft 320. The depressions 326*a* may be extended in the lengthwise direction of the shaft 320, and be extended in the circumferential direction of the shaft 320. Since the first groove 326 is discontinuously formed, stress concentrated on the specific portion of the shaft 320 may be dispersed while maintaining rigidity of the shaft 320 according to rotation of the drum 120, and thus, the lifespan of the shaft 320 may be extended.

Figure 10:
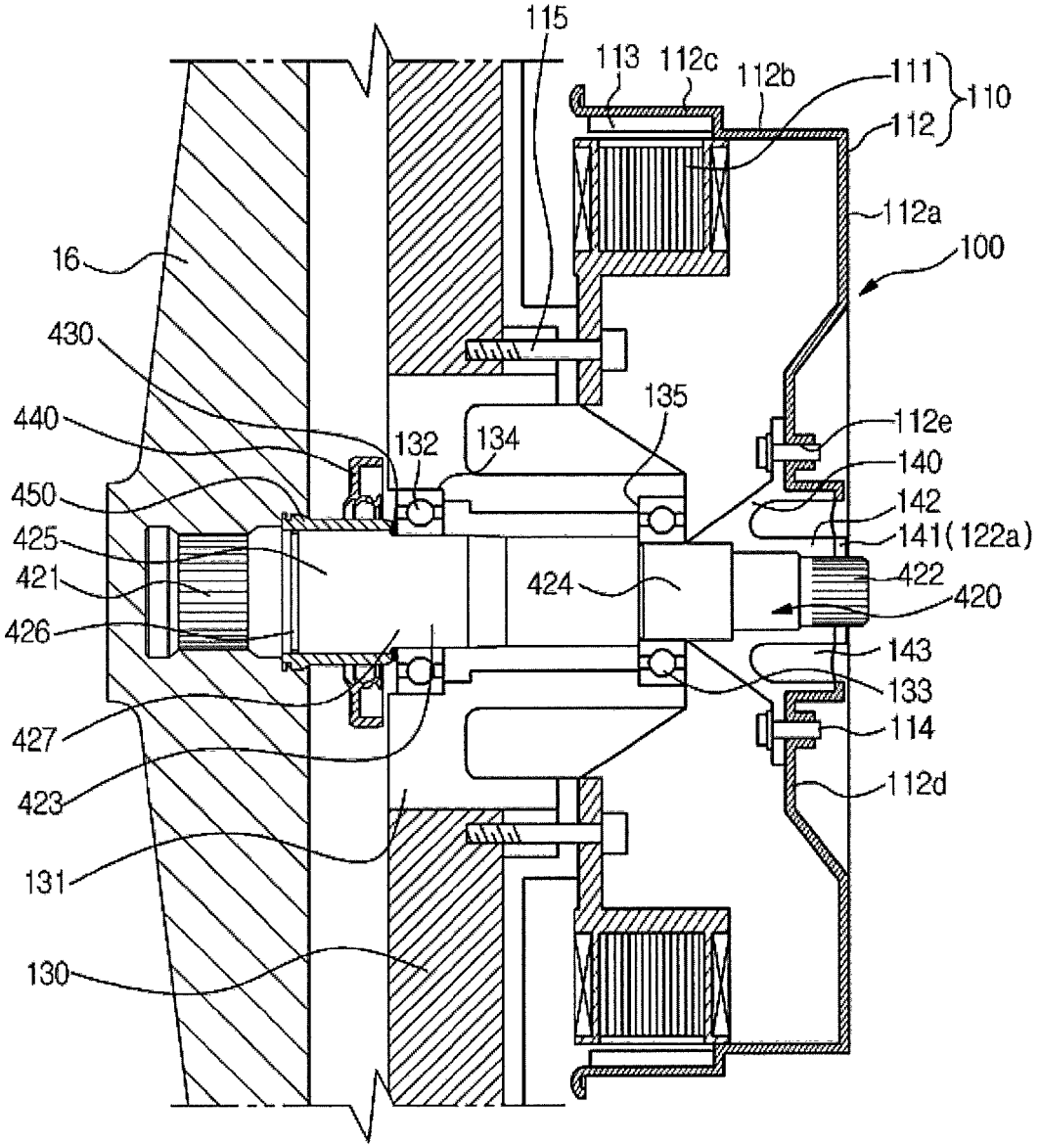
FIG. 10 is an enlarged view of the portion A of a drum washing machine in accordance with another embodiment of the present disclosure.
Figure 11:
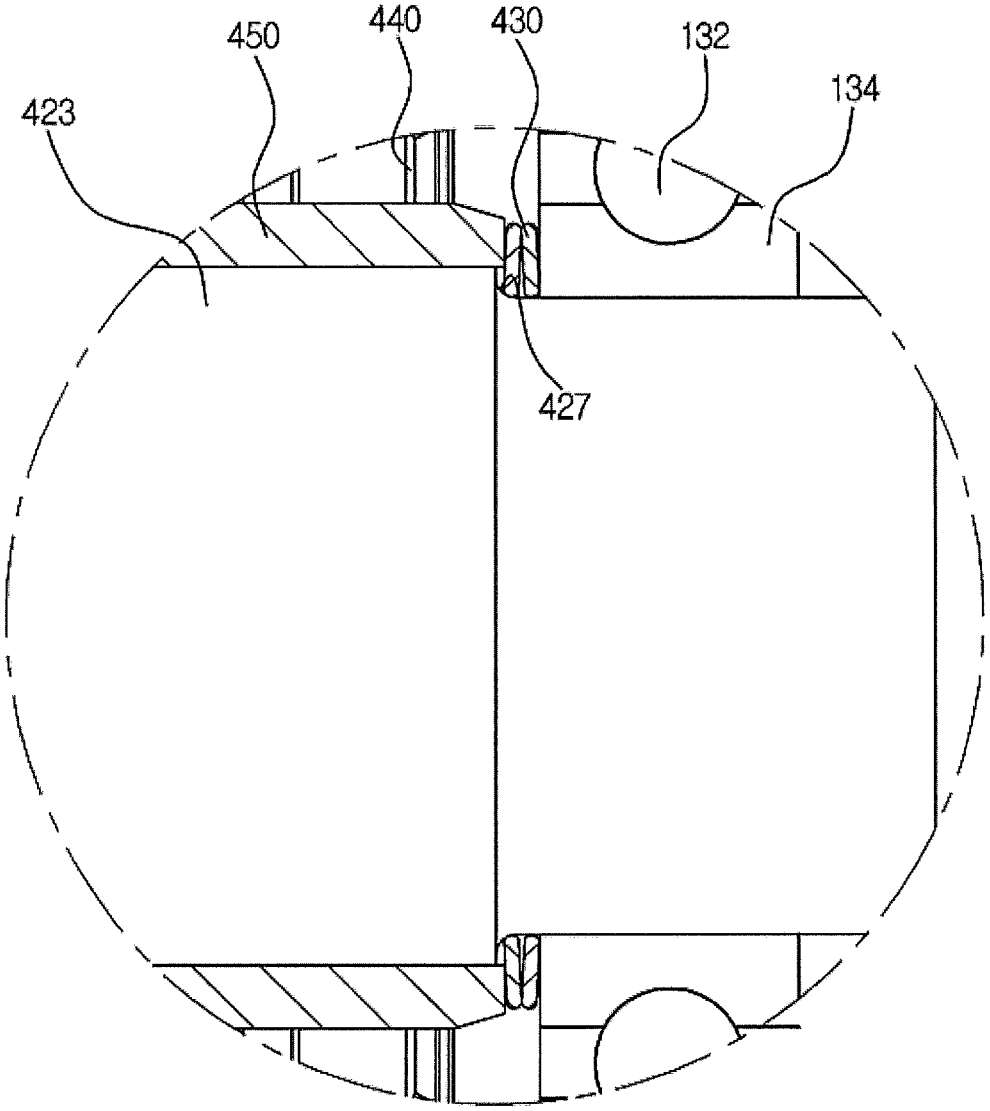
FIG. 11 is an enlarged view of a shaft of the drum washing machine in accordance with the embodiment of the present disclosure.
Figure 12:
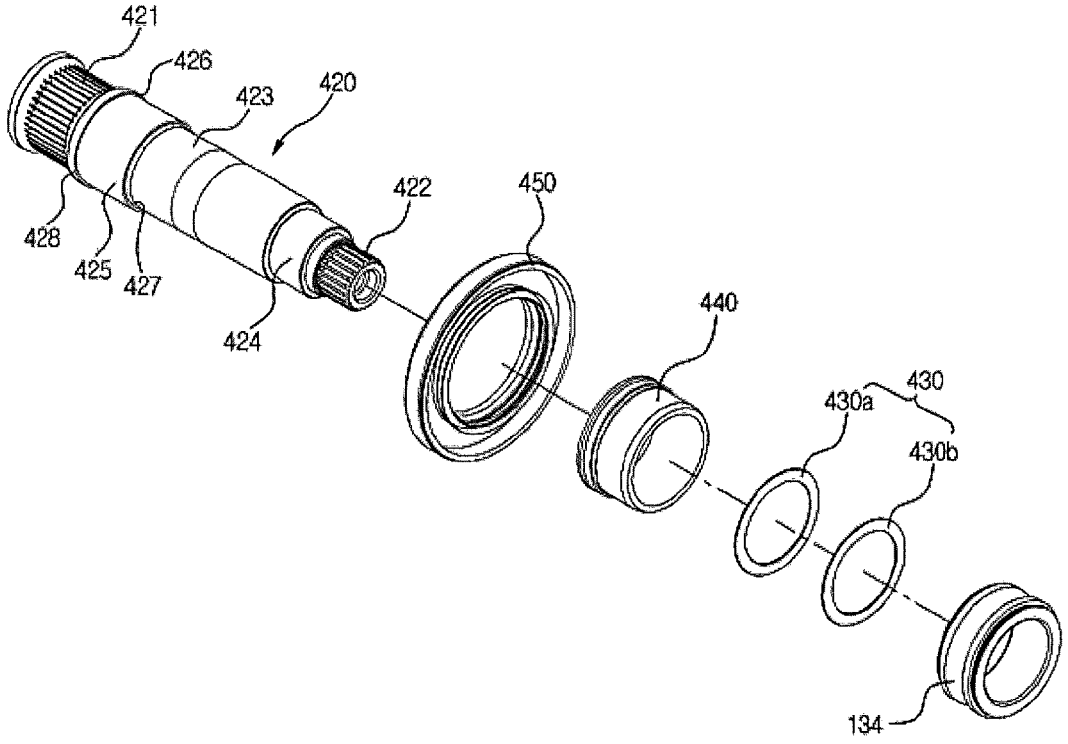
FIG. 12 is an exploded view illustrating the shaft and components combined with the shaft in accordance with the embodiment of the present disclosure.
Figure 13:
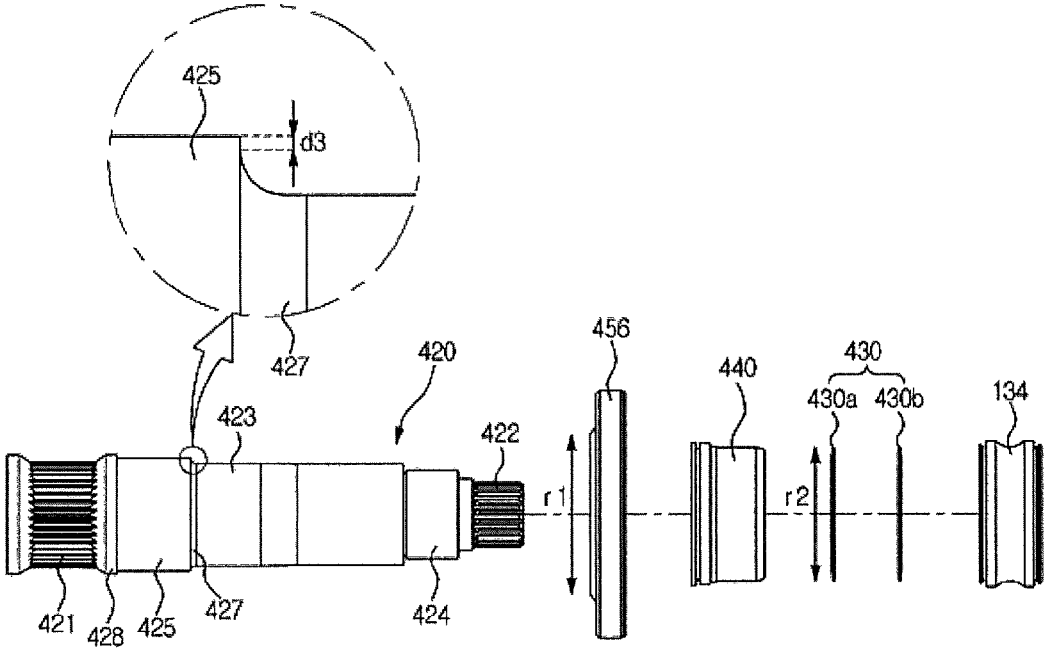
FIG. 13 is an exploded view illustrating the shaft and the components combined with the shaft in accordance with the embodiment of the present disclosure, seen from a different angle.

FIG. 10 is an enlarged view of the portion A of a drum washing machine in accordance with another embodiment of the present disclosure, FIG. 11 is an enlarged view of a shaft of the drum washing machine in accordance with the embodiment of the present disclosure, FIG. 12 is an exploded view illustrating the shaft and components combined with the shaft in accordance with the embodiment of the present disclosure, and FIG. 13 is an exploded view illustrating the shaft and the components combined with the shaft in accordance with the embodiment of the present disclosure, seen from a different angle.

Some parts in this embodiment which are substantially the same as those in the earlier embodiment are denoted by the same reference numerals even though they are depicted in different drawings and a detailed description thereof will thus be omitted because it is considered to be unnecessary.

In accordance with the embodiment of the present disclosure shown in FIGS. 10 to 13, an elastic member 430 may be combined with a shaft 420 having a drum combined part 421, a motor combined part 422, bearing mount surfaces 423 and 424, bushing mount surface 425 and projection portion 428. The elastic member 430 may be provided in a ring shape and be inserted into the shaft 420. For example, the elastic member 430 may include a leaf spring, and at least one elastic member 430 may be provided. In accordance with the embodiment of the present disclosure, the at least one the elastic member 430 may include two elastic members, i.e., a first elastic member 430*a* and a second elastic member 430*b*.

The shaft 420 may include at least one groove 426 and 427, as described above. The at least one groove 426 and 427 may be located in front of a first bearing 132. Among the at least one groove 426 and 427, one groove located close to the first bearing 132 is defined as a second groove 427, and the other groove is defined as a first groove 426. That is, a distance between the first bearing 132 and the second groove 427 is smaller than a distance between the first bearing 132 and the first groove 426.

The elastic member 430 may be located in the second groove 427. In accordance with the embodiment of the present disclosure, the second groove 427 has a stepped portion of a designated height difference d3 with the surface of the shaft 420 and thus, the elastic member 430 may be easily inserted into a predetermined position of the shaft 420. Further, such a stepped portion may prevent interference between the inner diameter of the elastic member 430 and the outer diameter of the shaft 420. Thereby, mislocation of the elastic member 430 by operation of the drum washing machine 1 due to interference between the elastic member 430 and the shaft 420 may be prevented. Further, the elastic member 430 may be maximally close to the outer surface of the shaft 420 due to the stepped portion. The second groove 427 may be rounded as well as have the stepped portion with the surface of the shaft 420.

A bushing 450 to prevent the surface of the shaft 420 from rusting may be provided on the surface of the shaft 420. The elastic member 430 may be located between the first bearing 132 and the bushing 450. Accordingly, the elastic member 430 is installed at a portion of the shaft 420 to which axial force is applied due to rotation of the shaft 420 and the bearings 132 and 135 and thus, adhesion between the bearings 132 and 135 and the shaft 420 may be increased by restoring force of the elastic member 430. Thereby, a rotational speed difference between the shaft 420 and the bearings 132 and 135 may be minimized and abrasion of the shaft 420 may be prevented.

A sealing member 440 to prevent moisture from permeating the bearings 132 and 135 may be installed on the outer surface of the bushing 450. The sealing member 440 may be provided in a ring shape and surround at least a portion of the bushing 450.

The outer diameter r2 of the elastic member 430 may be smaller than the inner diameter al of the sealing member 440. Thereby, when the elastic member 430 is inserted into the shaft 420, interference between the elastic member 430 and the sealing member 440 may be prevented. In more detail, when the drum 12 provided with the shaft 420 is inserted into the bearing housing 130 provided with the sealing member 440, if the inner diameter of the elastic member 430 is greater than the inner diameter of the sealing member 440, the elastic member 430 needs to be mounted on the bearings 132 and 135 prior to mounting of the sealing member 440 and it may obstruct assembly efficiency in manufacture of the drum washing machine. However, in the embodiment of the present disclosure, the inner diameter r1 of the sealing member 440 is greater than the outer diameter r2 of the elastic member 430 and thus, interference between the sealing member 440 and the elastic member 430 may be prevented.

Figure 14:
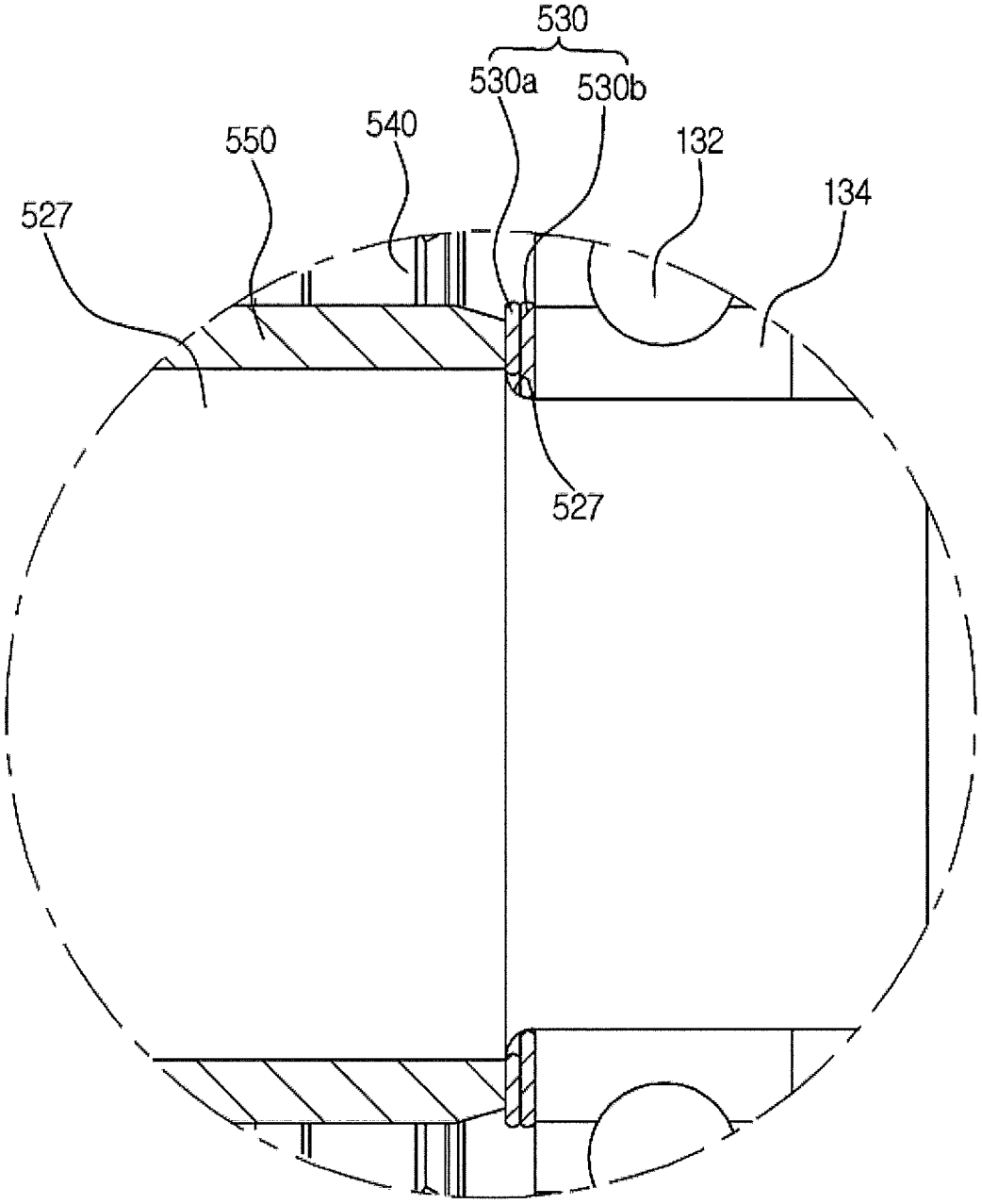
FIG. 14 is an enlarged view of a shaft of a drum washing machine in accordance with a further embodiment of the present disclosure.
Figure 15:
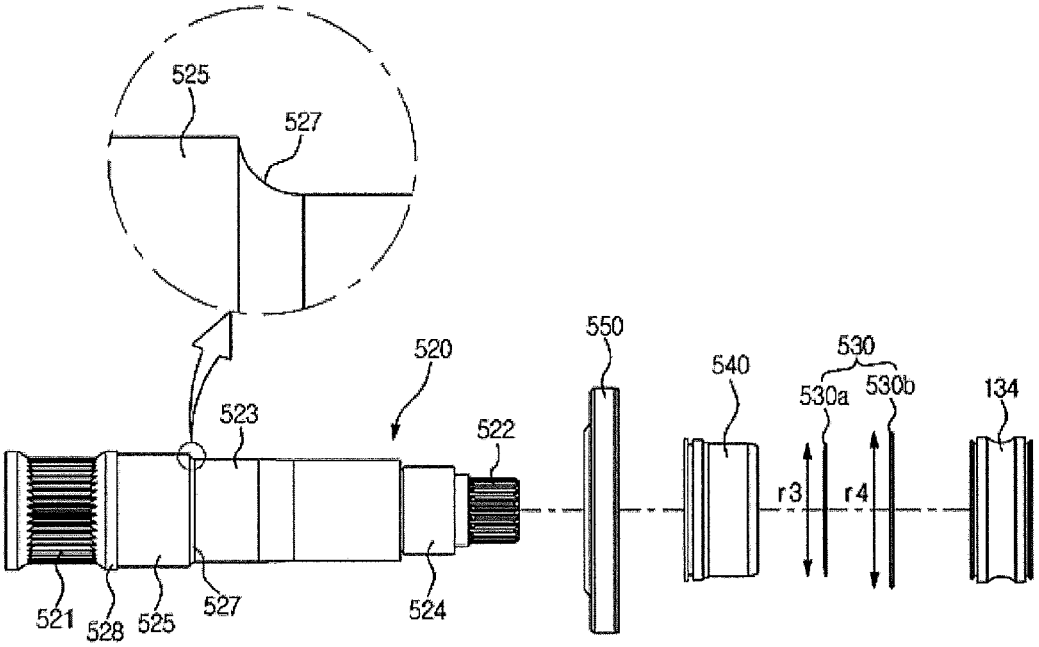
FIG. 15 is an exploded view illustrating the shaft and components combined with the shaft in accordance with the embodiment of the present disclosure, seen from a different angle.

FIG. 14 is an enlarged view of a shaft of a drum washing machine in accordance with a further embodiment of the present disclosure, and FIG. 15 is an exploded view illustrating the shaft and components combined with the shaft in accordance with the embodiment of the present disclosure, seen from a different angle.

In the embodiment shown in FIGS. 14 and 15, a shaft 520 may include a drum combined part 521, a motor combined part 522, bearing mount surfaces 523 and 524, bushing mount surface 525, a first groove 526, a second groove 527 and projection portion 528. At least one elastic member 530 may be combined with the shaft 520. Further, the shaft 520 may further include a sealing member 550 and a bushing 540 combined with the shaft 520.

The at least one elastic member 530 may be provided in a ring shape and include a leaf spring, in accordance with the embodiment of the present disclosure. In accordance with the embodiment of the present disclosure, the at least one the elastic member 530 may include a first elastic member 530*a* and a second elastic member 530*b*.

In accordance with this embodiment, the second groove 527 has no stepped portion with the surface of the shaft 520 and is rounded. In this case, interference between the elastic member 530 and the shaft 520 may be generated. In order to prevent such interference, the first elastic member 530*a* and the second elastic member 530*b* may have different inner diameters. Particularly, since the second groove 527 is rounded such that the diameter of the second groove 527 is gradually decreased in a direction from a bushing mount surface 525 to a bearing mount surface 523, the inner diameter r3 of the first elastic member 530*a* located close to the bushing mount surface 525 may be greater than the inner diameter r4 of the second elastic member 530*b*. In this case, interference between the shaft 520 and the first elastic member 530*a* may be prevented, and the first elastic member 530*a* may be closely adhered to the shaft 520 regardless of no stepped portion on the shaft 520.

As is apparent from the above description, a drum washing machine in accordance with one embodiment of the present disclosure may increase strength of a shaft to prevent damage to the shaft, and thus, the lifespan of the drum washing machine may be extended.

Therefore, a large-capacity drum washing machine may be mass-produced using such a shaft without change of the strength of the shaft.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A drum washing machine comprising:

a cabinet forming the external appearance of the drum washing machine;

a tub located within the cabinet;

a drum rotatably located within the tub; and a drive unit to rotate the drum, wherein the drive unit includes a motor;

a shaft provided with one end defined as a first point and combined with the drum and the other end defined as a second point and combined with a rotor of the motor, and transmitting power of the motor to the drum;

a first bearing and a second bearing located between the first point and the second point;

at least one bearing mount surface provided on the shaft, the first bearing and second bearing being mounted on the at least one bearing mount surface;

a bushing mount surface provided on the shaft and between the at least one bearing mount surface and the first point;

a first groove provided on the bushing mount surface to prevent damage to the shaft; and a bushing mounted on the bushing mount surface to surround a contour of the first groove.

2. The drum washing machine according to claim 1, wherein the at least one bearing mount surface includes a first bearing mount surface and a second bearing mount surface, and the first groove is separated from the first and second bearing mount surfaces.

3. The drum washing machine according to claim 1, wherein a second groove is provided at a boundary between the bushing mount surface and the at least one bearing mount surface.

4. The drum washing machine according to claim 1, further comprising at least one elastic member located between the bushing and the first bearing.

5. The drum washing machine according to claim 1, further comprising a sealing member surrounding at least one portion of the bushing to prevent moisture from permeating the bearings.

6. The drum washing machine according to claim 3, further comprising at least one elastic member located between the bushing and the first bearing, wherein the at least one elastic member is located in the second groove.

7. The drum washing machine according to claim 1, wherein sides of the first groove are inclined.

8. The drum washing machine according to claim 1, wherein sides of the first groove are rounded.

9. The drum washing machine according to claim 1, wherein the first groove is formed in a ring shape.

10. The drum washing machine according to claim 9, wherein the first groove is formed in a continuous ring shape.

11. The drum washing machine according to claim 1, wherein the first groove includes a plurality of depressions discontinuously provided.

12. The drum washing machine according to claim 1, wherein a distance between the drum and the bushing mount surface is shorter than a distance between the drum and the at least one bearing mount surface.

13. A drum washing machine which has a tub and a drum located within the tub, the drum washing machine comprising:

a motor generating power to rotate the drum; and a shaft transmitting power of the motor to the drum, wherein the shaft includes a drum combined part with which the drum is combined;

a motor combined part with which the motor is combined;

a bushing mount surface on which a bushing to prevent a surface of the shaft from rusting is mounted, the bushing mount surface having a stepped structure with respect to an adjacent surface of the shaft;

a bearing mount surface on which a bearing to facilitate rotation of the shaft is mounted, the bearing mount surface having a stepped structure with respect to an adjacent surface of the shaft; and a first groove provided at at least a portion of the bushing mount surface, the bushing surrounding a contour of the first groove.

14. The drum washing machine according to claim 13, further comprising:

a second groove provided on the bushing mount surface between the bushing and the bearing; and at least one elastic member located on the second groove.

15. The drum washing machine according to claim 14, wherein the second groove has a stepped portion with respect to the bearing mount surface.

16. The drum washing machine according to claim 14, wherein the second groove is rounded with respect to the bearing mount surface.

17. A drum washing machine comprising:

a cabinet forming the external appearance of the drum washing machine;

a tub located within the cabinet;

a drum rotatably located within the tub; and a drive unit to rotate the drum, wherein the drive unit includes a motor;

a shaft provided with one end defined as a first point and combined with the drum and the other end defined as a second point and combined with a rotor of the motor, and transmitting power of the motor to the drum;

a first bearing and a second bearing located between the first point and the second point;

a first groove provided on the shaft between the first bearing and the first point; and a bushing surrounding at least a portion of an outer surface of the shaft including a contour of the first groove.

18. The drum washing machine according to claim 17, further comprising a second groove provided on the shaft, the second groove being closer to the first bearing than the first groove.

19. The drum washing machine according to claim 18, further comprising at least one elastic member in a ring shape located between the first bearing and the bushing, the at least one elastic member being located on the second groove.

20. The drum washing machine according to claim 19, wherein the second groove has a stepped portion on the outer surface of the shaft.

21. The drum washing machine according to claim 20, wherein:

the at least one elastic member includes a first elastic member contacting the first bearing and a second elastic member contacting the bushing; and an inner diameter of the first elastic member and an inner diameter of the second elastic member are equal.

22. The drum washing machine according to claim 19, wherein the second groove is rounded with respect to the outer surface of the shaft.

23. The drum washing machine according to claim 22, wherein:

the at least one elastic member includes a first elastic member contacting the first bearing and a second elastic member contacting the bushing; and an inner diameter of the second elastic member is smaller than an inner diameter of the first elastic member.

24. The drum washing machine according to claim 19, further comprising a sealing member surrounding at least one portion of the bushing to prevent moisture from permeating the first bearing, wherein an outer diameter of the at least one elastic member is smaller than an inner diameter of the sealing member.

* * * * *